US009574808B2

(12) United States Patent
Woolley et al.

(10) Patent No.: US 9,574,808 B2
(45) Date of Patent: Feb. 21, 2017

(54) ACTIVE STRESS CONTROL DURING RAPID SHUT DOWN

(75) Inventors: Lance D. Woolley, Glastonbury, CT (US); Peter S. Matteson, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 1575 days.

(21) Appl. No.: 12/991,292

(22) PCT Filed: May 7, 2008

(86) PCT No.: PCT/US2008/062802
§ 371 (c)(1),
(2), (4) Date: Nov. 5, 2010

(87) PCT Pub. No.: WO2009/136916
PCT Pub. Date: Nov. 12, 2009

(65) Prior Publication Data

US 2011/0056221 A1 Mar. 10, 2011

(51) Int. Cl.
*F01K 23/10* (2006.01)
*F01K 23/08* (2006.01)
(Continued)

(52) U.S. Cl.
CPC ..... *F25B 41/00* (2013.01); *F01K 13/02* (2013.01); *F01K 25/08* (2013.01); *F25B 2400/19* (2013.01); *F25B 2500/27* (2013.01)

(58) Field of Classification Search
CPC ... F25B 41/00; F25B 2400/19; F25B 2500/27; F25B 2400/14; F01K 13/02; F01K 25/08; F01K 23/10; F01K 23/08; F02C 6/18
(Continued)

(56) References Cited

U.S. PATENT DOCUMENTS 4,582,765 A * 4/1986 Kothmann ..... H01M 8/04014 165/97
5,538,693 A * 7/1996 Olivier ..... F23G 7/068 110/245
(Continued)

FOREIGN PATENT DOCUMENTS

JP 55131511 A 10/1980
JP 5951112 3/1984
(Continued)

OTHER PUBLICATIONS

International Search Report and Written Opinion mailed Jul. 24, 2008 (10 pgs.).
(Continued)

*Primary Examiner* — Frantz Jules
*Assistant Examiner* — Martha Tadesse
(74) *Attorney, Agent, or Firm* — Carlson, Gaskey & Olds, PC

(57) ABSTRACT

A closed loop refrigerant expansion system with a tube and shell condenser is provided with a control which, upon shutdown, causes the flow of refrigerant to reverse from the evaporator to the condenser to thereby both reduce the amount of refrigerant vapor passing to the condenser and increase the amount of liquid refrigerant in the condenser to thereby reduce the maximum temperature load in the condenser. Reverse flow can be made to occur either by reversing the direction of the refrigerant pump or opening a bypass valve around the pump.

14 Claims, 1 Drawing Sheet

(51) Int. Cl.

| | |
|---|---|
| ***F02C 6/18*** | (2006.01) |
| ***F25B 41/00*** | (2006.01) |
| ***F01K 13/02*** | (2006.01) |
| ***F01K 25/08*** | (2006.01) |

(58) Field of Classification Search
USPC ..... 62/118, 527, 196.1, 196.4, 132, 160; 418/86; 60/39.13; 165/97
See application file for complete search history.

(56) References Cited

U.S. PATENT DOCUMENTS 6,000,231 A * 12/1999 Alsenz ..... F25B 5/02 62/278
6,481,973 B1 11/2002 Struthers
6,604,371 B2 * 8/2003 Ueno ..... F04B 39/0207 62/129
6,895,308 B2 * 5/2005 Coogan ..... G05B 19/042 700/275
7,100,380 B2 * 9/2006 Brasz ..... C09K 5/045 62/114
7,121,906 B2 * 10/2006 Sundel ..... 440/3
7,174,716 B2 2/2007 Brasz et al.
2004/0255593 A1 * 12/2004 Brasz ..... F02C 6/18 60/772
2009/0107159 A1 * 4/2009 Mann, III ..... B64F 1/364 62/239

FOREIGN PATENT DOCUMENTS

JP 04113172 A * 4/1992 ..... F25B 13/00
JP 10103023 A 4/1998

OTHER PUBLICATIONS

International Preliminary Report on Patentability mailed Nov. 18, 2010 (6 pgs.).

* cited by examiner

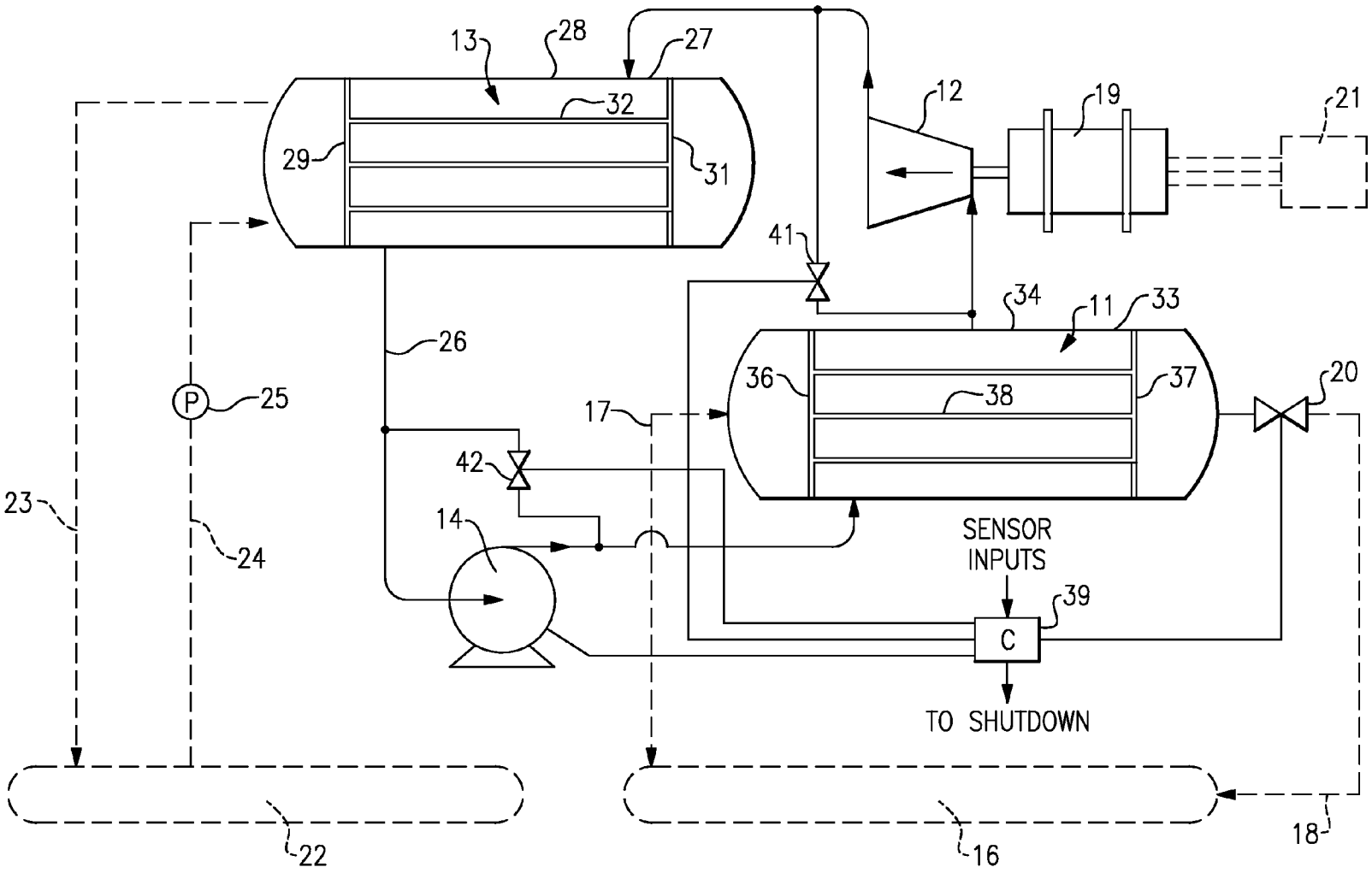
21
19
12
20
33
37
11
34
38
36
41
27
31
32
28
13
29
26
42
14
17
18
16
22
25
P
24
23
39
C
SENSOR INPUTS
TO SHUTDOWN

ACTIVE STRESS CONTROL DURING RAPID SHUT DOWN

TECHNICAL FIELD

This disclosure relates generally to vapor expansion systems and, more particularly, to a method and apparatus for reducing transient thermal stress in a condenser thereof.

BACKGROUND OF THE DISCLOSURE

Closed loop vapor expansion systems normally include, in serial flow relationship, a pump, an evaporator or boiler, a turbine, and a condenser, with a working fluid being circulated therein. A common approach for the evaporator and condenser is to use a tube and shell structure with the working fluid passing through one and another medium passing through the other, in heat exchange relationship therewith. In the case of the condenser, it is common to pass the hot refrigerant vapor from the turbine through the shell while cooling water is passed to the tubes from the cooling tower.

A condenser tube and shell heat exchanger comprises a shell with the plurality of tubes passing therethrough, with the tubes often being constructed with materials dissimilar from the shell. The use of copper in the tubes is often preferred because of its superior heat transfer characteristics, resistance to corrosion, or ease of use in manufacturing. However, because of the differences in the vessel and the tube materials, and their associated expansion coefficients, stress is created in such structures by their exposure to different temperatures and/or temperature difference from the manufacturing reference conditions. That is, at higher temperatures the thermal expansion of copper tubes will be substantially greater than that of steel in the vessel walls, and thereby create thermal stress in the structure.

The problem of thermal stress becomes more serious during periods of emergency shut down when the cooling water is no longer flowing through the condenser, but, because of the continued heat transfer and vaporization within the evaporator, hot refrigerant vapor continues to flow into the condenser, elevating the material temperatures

DISCLOSURE

Briefly, in accordance with one embodiment of the disclosure, thermal stress within a condenser is reduced at system shutdown by responsively causing the liquid refrigerant to flow in reverse, from the evaporator to the condenser to thereby limit the temperature rise that would otherwise result in the condenser.

In the drawings as hereinafter described, a preferred embodiment is depicted; however, various other modifications and alternate constructions can be made thereto without departing from the spirit and scope of the disclosure.

BRIEF DESCRIPTION OF THE DRAWINGS

FIG. 1 is a schematic illustration of an organic rankine cycle system with the present invention incorporated therein.

DETAILED DESCRIPTION OF THE DISCLOSURE

Shown in FIG. 1 is a vapor expansion system in the form of an organic rankine cycle system (ORC) which includes, in serial working-fluid-flow relationship, an evaporator 11, a turbine 12, a condenser 13 and a pump 14. The working fluid flowing therethrough can be of any suitable refrigerant such as refrigerant R-245fa, R134, pentane, for example.

The energy which is provided to drive the system is from a primary heat source 16 by way of a closed loop which connects to the evaporator 11 by way of lines 17 and 18. A valve 20 is provided to turn this flow on or off and may be located either upstream or downstream from the heat exchanger 16. The primary heat source 16 may be of various types such as, for example a geothermal source, wherein naturally occurring hot fluids are available below the surface of the earth.

After the working fluid is heated in the evaporator 11, it passes as a high temperature, high pressure vapor to the turbine 12 where the energy is converted to motive power. The turbine 12 is drivingly attached to a generator 19 for generating electrical power that then passes to the grid 21 for further distribution.

After passing to the turbine 12, the working fluid, which is now a vapor which is at a reduced temperature and pressure, passes to the condenser 13, which is fluidly connected to a cooling water source 22 by lines 23 and 24. The condenser 13 functions to condense the working fluid vapor into a liquid, which then flows along line 26 to the pump 14, which then pumps the liquid working fluid back to the evaporator 11 by way of line 27.

It will be seen that the condenser 13 comprises a steel vessel or shell 27, constructed of a material such as steel, with cylindrical side walls 28 and end walls 29 and 31. Extending between and connected at their ends to the end walls 29 and 31 are a plurality of tubes 32 constructed of a metal that is different from that of the shell 27, such as copper. The copper tubes 32 are adapted to conduct the flow of cooling water that flows from the cooling water source 22 through the line 24, through the series of tubes 32 and then back along line 23 to the cooling water source 22. The flow of cooling water is caused by a pump 25 or, alternatively by gravity feed from the tower (not shown). The vessel 27 is adapted to receive the flow of refrigerant vapor from the turbine 12, with the refrigerant vapor then being condensed by the transfer of heat to the cooling water from the tubes 32, with the condensed refrigerant then flowing along line 26 to the pump 14.

It should be recognized that, since the shell side walls 28 are made of steel, and the tubes 32 are made of copper, for example, their respective coefficients of expansion are different such that, as temperatures change, the expansion and contraction of these members creates thermal stresses in the structure. Thus, at higher temperatures, the thermal stresses may be sufficient to cause buckling or other structural failures. Thus, it is desirable to limit the maximum temperature load on the heat exchanger 13 to thereby prevent or reduce these thermal stresses.

The structure of the evaporator 11 is similar in that it includes a vessel or shell 33 with cylindrical side walls 34 and end walls 36 and 37, with a plurality of tubes 38 extending between the end walls 36 and 37. The evaporator is normally constructed of the same material, such as steel, for both the shell and the tubes. As a result, the stresses increase when tube and shell temperatures deviate one from the other. In this case, removing the refrigerant allows the tube temperatures to approach the same temperature as the shell, which also reduces stresses for a similar material case.

The shell is adapted to receive the flow of hot fluids from the heat exchanger 16, along line 17, and after passing through the shell 33 it passes through the valve 20 in the line 18 and back to the heat exchanger 16. The refrigerant passes from the pump 14, through the series of tubes 38, where it is heated by heat transfer from the hot fluid in the shell 33, with the resulting high pressure, high temperature refrigerant vapor then passing to the turbine 12.

When the system is shut down, the valve 20 is closed, as would occur automatically by a control 39 in response to selective sensor inputs indicating one or more unfavorable opening conditions, or if the grid is lost, for example, a bypass valve 41 is opened to prevent further energy from being passed to the turbine 12 as to possibly cause over speeding and the pump 14 is turned off. What would normally occur then is as follows.

Even though the hot fluid is no longer flowing through the evaporator shell 33, there is still hot fluid within the shell 33. Thus, heat continues to be transferred to the refrigerant in the tubes 38, with the resultant high temperature vapor being passed from the tubes 38 though the bypass valve 41 and to the condenser shell 27. However, since the cooling water from the cooling water source 22 is no longer flowing through the tubes 32, the temperatures in the shell 27 will continue to rise and, if not controlled, can result in excessive thermal stresses and possible failure. This problem is overcome by a change in the normal operation as described hereinabove.

At shut down, the control 39 senses the shutdown condition and responsively causes the refrigerant flow to reverse direction, i.e. from the evaporator 11 to the condenser 13. This can be accomplished in either of two ways. One is to cause the pump 14 to operate in reverse such that liquid refrigerant is pumped from the tubes 38 of the evaporator 11 and into the shell 27 of the condenser 13. The other approach is to provide a bypass valve 42 to bypass the pump 14, such that, when the bypass valve is opened, the higher pressure in the evaporator causes the refrigerant to flow from the evaporator 11 to the condenser 13. Either of these approaches brings about favorable changes in both the evaporator 11 and the condenser 13 to address the problem as discussed hereinabove. In the evaporator 11, since there is less liquid refrigerant in the tubes 38, there will be less liquid refrigerant for the hot fluids to act on and therefore less hot vapor passing through the bypass valve 41 and to the shell 27.

In the condenser, there will now be a flow of liquid refrigerant flowing into the shell 27 to thereby reduce the temperatures therein. The joint results of these two occurrences therefore tend to substantially reduce the maximum temperature load in the condenser 13.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method of reducing the maximum temperature load in a tube and shell condenser of a closed loop refrigerant expansion system, comprising the steps of:

providing a pump for pumping liquid refrigerant from the condenser to an evaporator during normal operation;

a turbine being provided between said condenser and said evaporator, and driving a generator;

sensing when the system is shut down and responsively causing the liquid refrigerant to flow in reverse from the evaporator to the condenser to thereby both reduce the amount of refrigerant vapor passing to the condenser and increase the amount of liquid refrigerant in the condenser; and the step of causing the flow to reverse is accomplished by one of (a) operating said pump in reverse, or (b) opening a bypass valve to allow the refrigerant to flow around said pump.

2. A method as set forth in claim 1 wherein the step of reversing the flow is accomplished by operating said pump in reverse.

3. A method as set forth in claim 1 wherein the step of reversing the flow is accomplished by opening said bypass valve to allow the refrigerant to flow around said pump.

4. A method as set forth in claim 1 and including the further step of sensing when the temperature conditions are favorable and causing the reverse flow of refrigerant to be discontinued.

5. A method as set forth in claim 4 wherein the temperature condition sensed is the temperature of the refrigerant leaving the evaporator.

6. A method as set forth in claim 1 wherein the condenser tubes and shell are composed of dissimilar material.

7. A method as set forth in claim 6 wherein the tubes are composed of copper and the shell is composed of steel.

8. Apparatus for reducing the maximum temperature load in a tube and shell condenser of a closed loop refrigerant expansion system, comprising:

a pump for pumping liquid refrigerant from the condenser to an evaporator during normal operation;

a turbine between said condenser and said evaporator, and driving a generator;

a control for sensing when the system is shut down and responsively causing the liquid refrigerant to flow in reverse from the evaporator to the condenser to thereby both reduce the amount of refrigerant vapor passing to the condenser and increasing the amount of liquid refrigerant in the condenser; and the control moves the flow in reverse by one of (a) operating said pump in reverse, or (b) opening a bypass valve to allow the refrigerant to flow around said pump.

9. Apparatus as set forth in claim 8 wherein the control is adapted to reverse the flow by operating said pump in reverse.

10. Apparatus as set forth in claim 8 and further wherein said control is adapted to open said bypass valve when the system is shut down.

11. Apparatus as set forth in claim 8 wherein the control is adapted to sense when the temperature conditions are favorable and responsively cause the reverse flow of refrigerant to be discontinued.

12. Apparatus as set forth in claim 11 wherein the temperature condition sensed is the temperature of the refrigerant leaving the evaporator.

13. Apparatus as set forth in claim 8 wherein the condenser tubes and shell are composed of dissimilar materials.

14. Apparatus as set forth in claim 13 wherein the tubes are composed of copper and the shell is composed of steel.

* * * * *